United States Patent [19]

Blizzard et al.

[11] Patent Number: 4,585,067

[45] Date of Patent: Apr. 29, 1986

[54] METHOD AND APPARATUS FOR STOPPING WELL PRODUCTION

[75] Inventors: William A. Blizzard, Houston; James K. Garner, Jr., Pearland; John D. Anderson, Humble, all of Tex.

[73] Assignee: Camco, Incorporated, Houston, Tex.

[21] Appl. No.: 645,575

[22] Filed: Aug. 29, 1984

[51] Int. Cl.[4] ..... E21B 34/08

[52] U.S. Cl. ..... 166/386; 166/319; 166/323

[58] Field of Search ..... 166/386, 373, 319–321, 166/323, 325, 332

[56] References Cited

U.S. PATENT DOCUMENTS 3,750,752 8/1973 Mott ..... 166/319

4,161,960 7/1979 Watkins ..... 166/323 X

*Primary Examiner*—Stephen J. Novosad

*Assistant Examiner*—Thuy M. Bui

*Attorney, Agent, or Firm*—Fulbright and Jaworski

[57] ABSTRACT

A method and valve for stopping production of an oil and/or gas well by injecting a fluid from the outside of a well conduit into the well bore through a check safety valve. The valve, initially in the open position, is actuated to the closed position by an increase of the pressure outside of the conduit relative to the inside pressure. A communication path from the outside of the conduit to the inside of the conduit above the safety valve is opened by pressure in the conduit below the closed safety valve. Fluid is injected into the open communication path through the safety valve to kill well production while maintaining a safety check on the production fluid below the safety valve. The valve may be relatched to its initial open position and reactuated.

13 Claims, 10 Drawing Figures

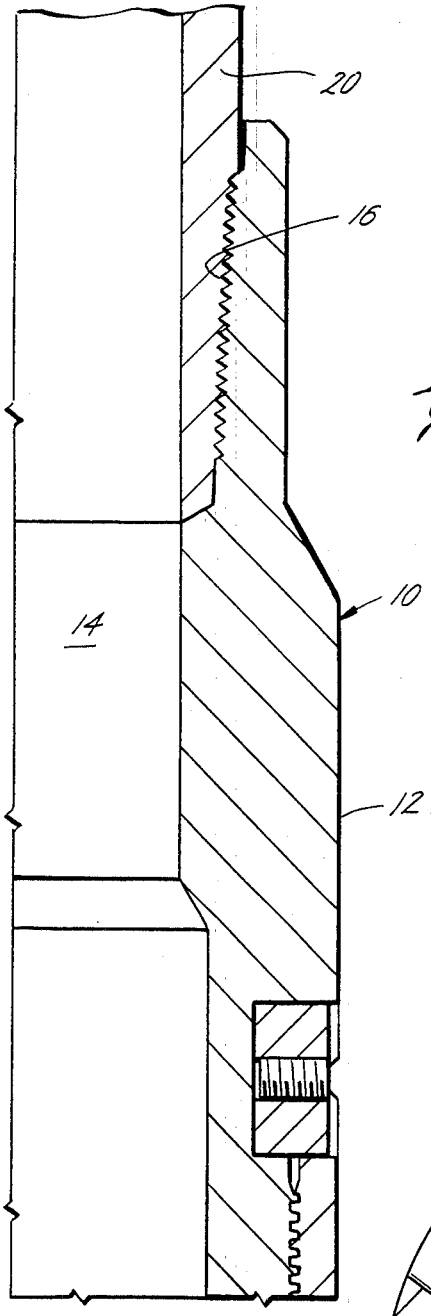
Fig. 1A
Fig. 2
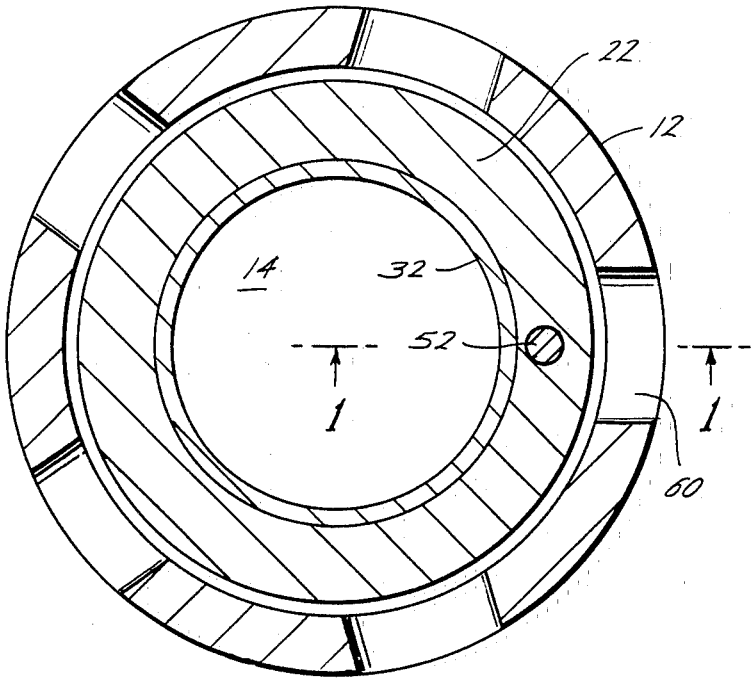

METHOD AND APPARATUS FOR STOPPING WELL PRODUCTION

BACKGROUND OF THE INVENTION

It is well known to stop production of an oil and/or gas well by means of injecting a fluid of controlled weight and composition down a line and/or valve, which is generally known as a choke and kill system, into the production tubing.

The present invention is directed to a method and apparatus to stop production of an oil and/or gas well by injecting fluid from the annular space between the well casing and the production tubing and into the bore of the production tubing and through a check-type safety valve. The valve is actuated by a minimal amount of annular to tubing pressure differential whereby the well casing is protected from overpressure. The valve is positioned to receive injection fluid by the well pressure.

SUMMARY

The present invention is directed to a method and apparatus for stopping production of an oil and/or gas well. The method is directed to inserting a safety valve in the well conduit in the open position, actuating the safety valve to the closed position by an increase of pressure outside of the conduit relative to the pressure on the inside of the conduit. After the valve is closed, communication of fluid from the outside of the conduit to the inside of the conduit above the safety valve is established by pressure in the conduit below the safety valve. Injection fluid is pumped down the outside of the conduit, through the communication path, and through the check safety valve to kill production through the conduit while maintaining a safety check on the fluid in the conduit below the safety valve. Production in the well may be reactivated by closing the communication path and releasably latching the safety valve in the open position.

A further object of the present invention is directed to the method of killing the production of an oil and/or gas well through a well conduit by inserting a safety valve in the well conduit and initially and releasably holding the valve in the open position by a piston and cylinder assembly which is exposed to pressure in the well conduit and to pressure outside of the well conduit. The assembly is actuated to move the valve to the closed position by an increase in pressure outside of the conduit relative to the pressure inside of the conduit. A communication path from the outside of the conduit to the inside of the conduit above the valve is opened by moving the valve upwardly in the conduit by pressure in the conduit below the closed safety valve. Kill fluid is then injected from the outside of the conduit through the communication path above the safety valve and through the safety valve by opening the check valve to kill production while maintaining a safety check in the conduit.

Still a further object of the present invention is the provision of a choke and kill valve for use in a well conduit having a housing with a bore therethrough and a sleeve telescopically movable in the housing about the bore. A valve closure member is positioned in the housing and connected to the sleeve and is movable between open and closed positions in the bore. A flow tube is longitudinally movable in the housing for controlling the movement of the valve closure member and biasing means biases the flow tube in a direction for causing the valve closure member to move to the closed position. Releasable latching means initially holds the flow tube in position holding the valve closure member in the open position. A biased piston and cylinder assembly initially engages the releasing latch and holds the latch engaged and the assembly is exposed on opposite sides to pressure in the housing and pressure outside of the housing and is disengaged upon a predetermined increase in outside pressure relative to bore pressure. The body and the sleeve include openings which when aligned by movement of the sleeve by well pressure allows fluid to be injected into the bore from the outside of the housing.

Still a further object is wherein a fluid chamber is provided between the sleeve and the housing having a small outlet for cushioning the movement of the sleeve relative to the housing.

Yet a further object is wherein the releasable latch means is relatchable.

Still a further object of the present invention is the provision of release means between the sleeve and the housing initially positioning the sleeve relative to the housing.

Still a further object of the present invention is the provision of arming means between the sleeve and the flow tube for initially preventing movement of the flow tube relative to the sleeve.

Still a further object of the present invention is wherein the cross-sectional area of the opening through the housing and sleeve are substantially equal to the cross-sectional area of the bore.

Yet a still further object of the present invention is the provision of metal seals on the sleeve on each side of the opening in the body and the opening in the sleeve for preventing fluid bypass around the sleeve regardless of the position of the sleeve relative to the housing.

Still a further object of the present invention is the provision of a choke and kill valve for use in a well conduit having a housing with a bore therethrough and an opening in the housing. A sleeve is telescopically movable in the housing about the bore and a check valve closure member is positioned in the housing and connected to the sleeve and is movable between open and closed positions in the bore. A flow tube is longitudinally movable in the housing for controlling the movement of the valve closure member and spring biasing means between the sleeve and the flow tube biases the tube in a direction for causing the valve member to move to the closed position. Releasable and reengageable latch means initially holds the flow tube in position holding the valve closure member open. A spring biased piston and cylinder assembly initially engages the releasable latch holding the latch engaged. The assembly is exposed on one side through the housing opening to pressure outside of the housing and is exposed on the other side to pressure inside of the housing bore and is disengaged from the latch upon a predetermined increase of outside pressure relative to bore pressure. A communication path extends from the outside of the housing, through the housing and sleeve, and into the bore, and release means are provided between the sleeve and the housing initially positioning the sleeve relative to the housing to close the communication path.

Other and further objects, feature and advantages will be apparent from the following description of a presently preferred embodiment of the invention, given for the purpose of disclosure, and taking in conjunction with the accompanying drawings.

BRIEF DESCRIPTION OF THE DRAWINGS

FIGS. 1A, 1B, 1C, 1D and 1E are continuations of each other and are elevational views, in quarter section, of the preferred embodiment of the choke and kill valve of the present invention, FIG. 2 is a cross-sectional view, taken along the lines 2—2 of FIG. 1D, FIGS. 3A, 3B and 3C are continuations of each other and are elevational views in quarter section of another embodiment of the choke and kill valve shown in the open position.

DESCRIPTION OF THE PREFERRED EMBODIMENTS

Figure 1B:
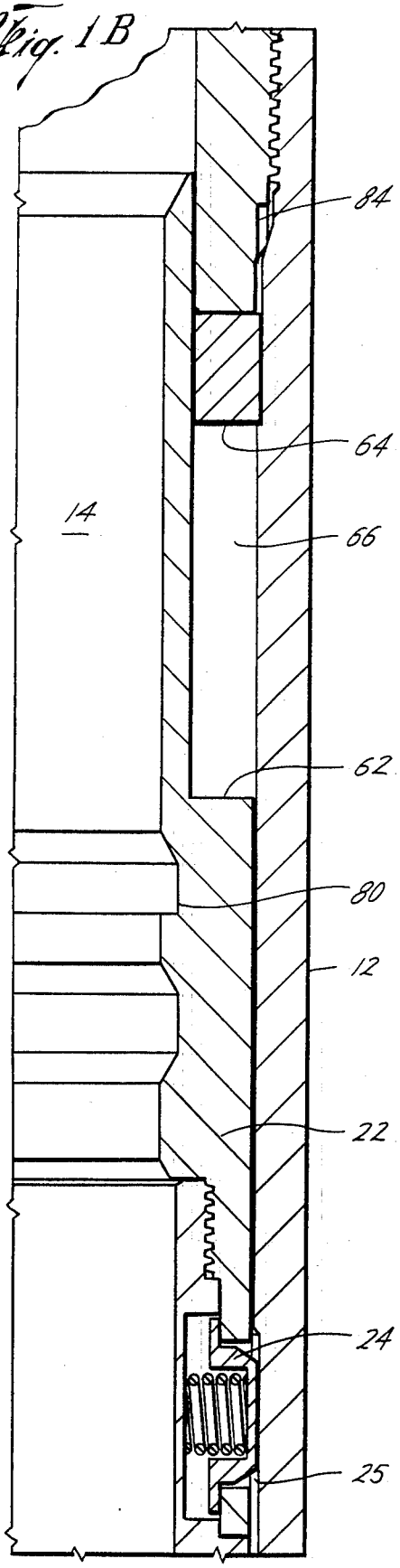
Figure 1C:
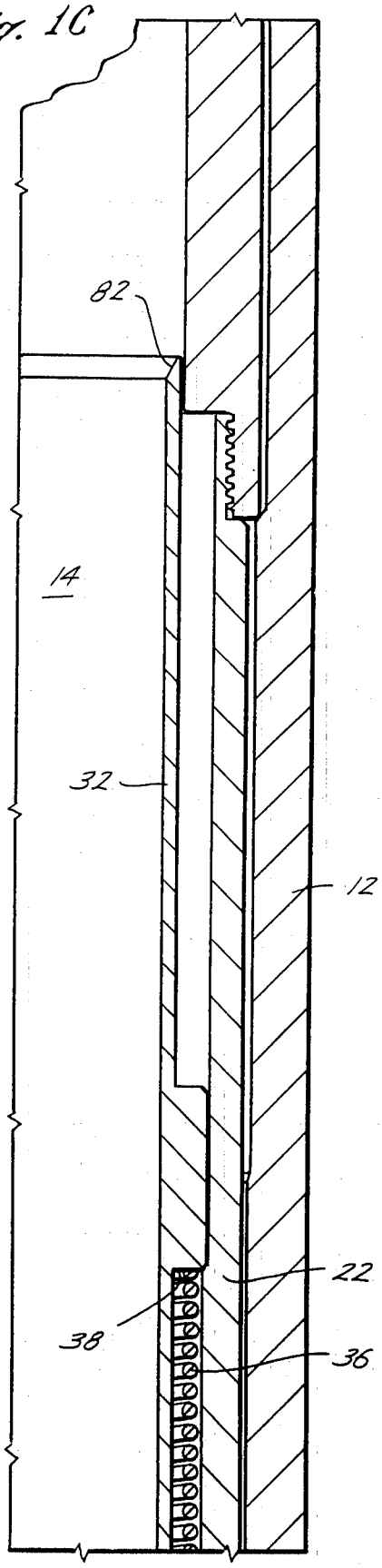

While the present invention will be described as a tubing retrievable type of valve which is threadably connected within the production tubing string, and with a flapper type check safety valve, the present valve may also be a retrievable type valve which is insertable in and removable from the inside of a production string and may have other types of check valve elements.

Referring now to FIGS. 1A, 1B, 1C, 1D, 1E and 2, the choke and kill valve is generally indicated by the reference numeral 10 and generally includes a housing 12 having a bore 14 therethrough and in case of a tubing retrievable valve may include connecting means such as an upper thread 16 and a lower thread 18 for connection in an oil and/or gas well production tubing or conduit 20. A tubular sleeve 22 is telescopically movable in the housing 12, but release means such as spring loaded locator blocks 24 on the sleeve 22 coact with a recess 25 in the housing 12 for initially positioning the sleeve 22 relative to the housing 12 as will be more fully described hereinafter.

Figure 1D:
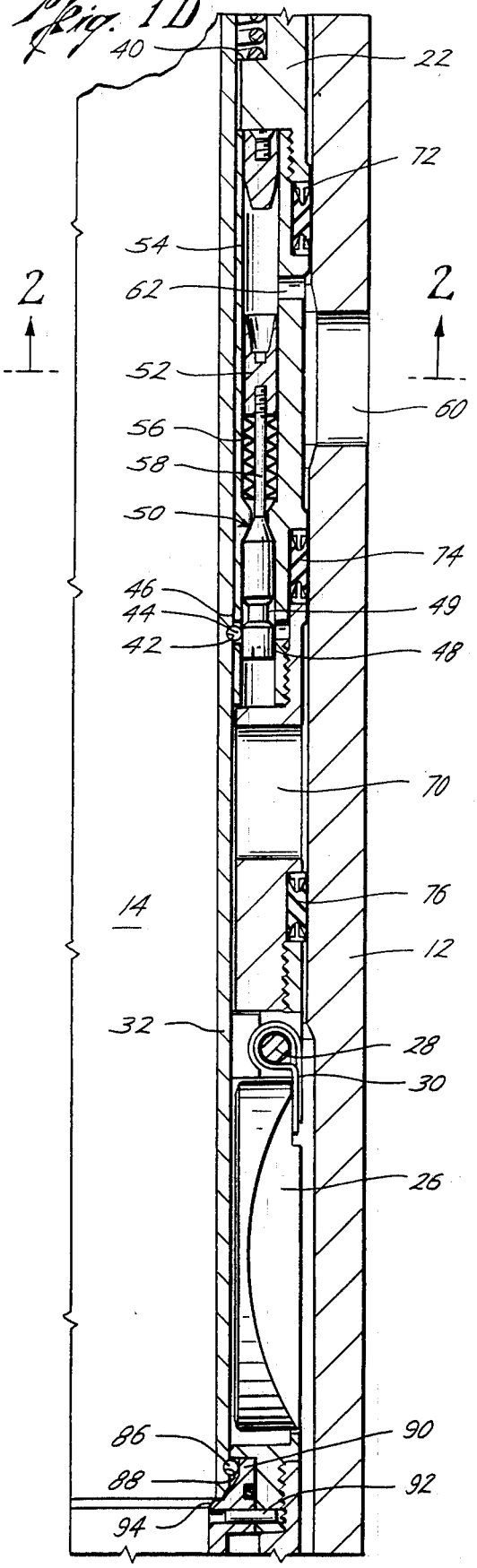

A check valve closure member such as flapper valve 26 is positioned in the housing 12 and connected to the sleeve 22 by a pivot connection 28 and is movable from an open position, as best seen in FIG. 1D, to a closed position to shut off upward flow through the bore 14, but to allow downward flow through the bore 14. The valve closure member 26 is urged to a closed position by a spring 30 and is moved to an open position by a flow tube 32.

Flow tube 32 is longitudinally movable in the housing for controlling the movement of the check valve member 26 and when moved relative to the sleeve 22 to a downward position moves the valve closure member 26 to the open position. When the flow tube 32 is moved upwardly out of the path of movement of the valve member 26, the valve member 26 is moved to the closed position by the action of a spring 30 and fluid moving upwardly through the bore 14. Biasing means such as spring 36 is provided between a shoulder 38 on the flow tube 32 and a shoulder 40 on the sleeve 22 for biasing the flow tube 32 in a direction for causing the valve member 26 to move to the closed position.

The valve 10 is normally installed in the production tubing 20 in an open position. In order to hold the valve element 26 in the open position with the flow tube 32 in a downward position, a releasable and reengageable latch means is provided intially holding the flow tube 32 in a downward position. Thus, referring to FIG. 1D, a groove 42 is provided in the outside of the flow tube 32 and a locking ball 44 is engaged in the groove 42 and in a slot 46 in the sleeve 22 thereby preventing longitudinal movement of the flow tube 32 relative to the sleeve 22. The ball 44 is initially prevented from being displaced from the groove 42 by a shoulder 48.

A spring biased piston and cylinder assembly generally indicated by the reference numeral 50 is provided initially holding the releasable latch means in engagement with the flow tube 32. The assembly 50 includes a metal piston 52 movable in a cylinder 54. The piston 52 is biased upwardly in the cylinder 54 by a biasing spring 56. A piston rod 58 is connected to the shoulder 48 and also supports a release groove 49. Initially, the spring 56 retains the shoulder 48 behind the locking ball 44. The assembly is exposed on one side to pressure outside of the body 12 which would be the annulus between the valve 10 and well casing (not shown) and is exposed on the other side to pressure inside of the production tubing 20 and the bore 14. The pressure in the bore 14 flows around the flow tube 32, since there are no seals between the flow tube 32 and the sleeve 22, and acts on the underside of the piston 52 in a direction to maintain the releasable latch in the latched position. The body 12 includes one or more openings 60 leading from the outside of the housing 12 to the inside of the housing 12 into communication with the upper portion of the cylinder 54 through a passageway 62 in the sleeve 22. Therefore, the upper end of the piston 52 is exposed to pressure in the annulus outside of the valve 10.

Release of the flow tube 32 is actuated by an increase of the annular or outside fluid pressure relative to the tubing or bore pressure differential of a predetermined set value. Upon a predetermined increase in the outside pressure relative to the inside pressure, the piston 52 moves downwardly moving the release groove 49 in register with the ball 44 which therefore moves out of the groove 42 at which time the biasing spring 36 moves the flow tube 32 upwardly allowing the check valve member 26 to close the bore 14.

After the check valve 26 is closed, the formation pressure in the well conduit 20 below the valve closure member 26 moves the sleeve 22 to receive injection fluid from the annulus outside of the valve 10. That is, with the check valve 26 closed, the pressure in the tubing 20 above the element 26 bleeds off to the surface and the formation to tubing pressure differential across the check valve 26 generates a force below the valve 26 to overcome the spring loaded locator blocks 24 (FIG. 1B). Once the forces reach a predetermined set value, the locator blocks 24 release the sleeve 22 from its location in the valve body 12, causing the sleeve 22 to move upwardly until the sleeve shoulder 62 engages the housing shoulder 64. It is to be noted that a fluid chamber 66 is formed between the sleeve 22 and the housing 12 having a fluid outlet between the sleeve 22 and the housing 12 whereby the fluid chamber 66 acts as a cushion or dash pot.

A fluid path is then established between the outside of the housing 12 and the bore 14 which includes one or more fluid openings 60 in the housing 12 and one or more fluid openings 70 in the sleeve 22. The communication path is closed when the sleeve 22 is in its initial position by the position of metal seals 72, 74 and 76. However, when the sleeve 22 is moved upwardly with the shoulder 62 contacting the shoulder 64 on the body 12, the openings 60 and 70 are aligned. Injection fluid may now be pumped down the annulus between the outside of the body 12 and the inside of the casing (not shown), through the communication path consisting of the openings 60 and 70 and downwardly through the check valve 26, which will open in response to fluid flow, and the fluid is pumped into the production tubing 20 and through the check valve 26 to kill the production. However, the check valve 26 maintains a safety check on the formation fluid below the flapper 26 and in the event of a pressure surge from below which would overcome the injection fluid, the check valve 26 will close protecting the well. In the process of injecting fluid into the bore 14 to stop production or kill the well, it is desirable to inject the kill fluid at as large a rate as possible. Therefore, it is preferable that the flow area of the communication path consisting of the openings 60 and 70 is equal to the total cross-sectional area of the bore of the production tubing 20 thereby allowing maximum possible injection rate.

The valve 10 of the present invention may also be reactivated after the well has been controlled in that a suitable shifting tool, such as a wire-line tool, engages the profile 80 on the sleeve 22 and the top 82 of the flow tube 32 to relocate the sleeve 22 and the flow tube 32 in its original position in which the spring loaded assembly 50 will again move upwardly and the latch ball 42 will fall into the groove 42. The valve 10 is then in its original position with communication between the annulus and tubing now sealed off and the check valve member 26 again moves to the open position allowing full flow well production through the tubing 20.

It is to be noted that the seals in the valve 10 including the check valve 26, metal seals 72, 74 and 76, and the metal seal 84 between the joints of the housing 12 are metal thereby eliminating problems caused by elastomer seals which degrade in hostile well environment.

Figure 1E:
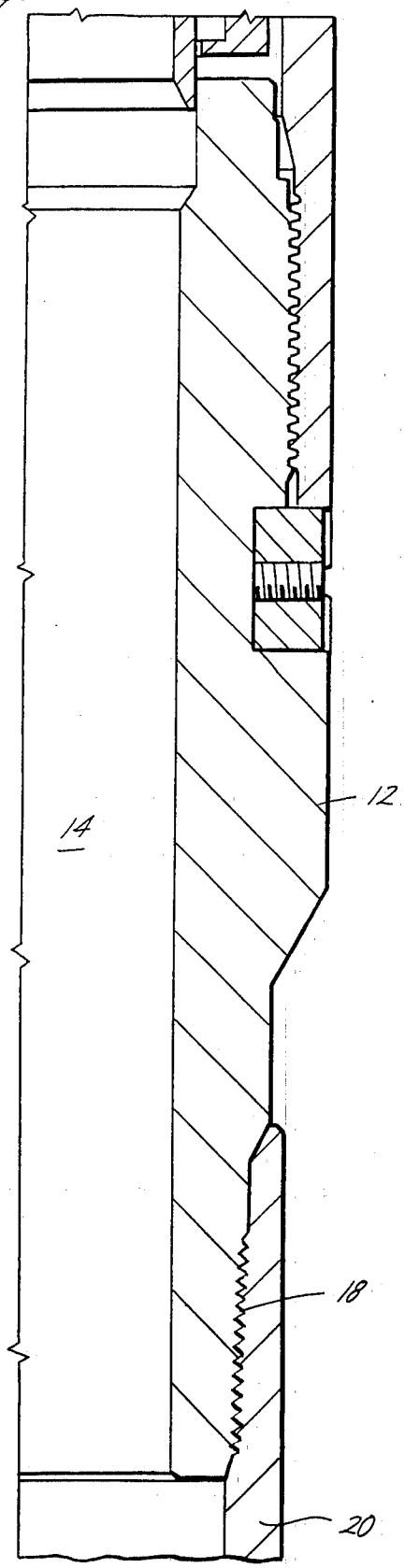

As pressure differentials may occur in the initial completion or workover of a well, it may be desirable to disarm the choke and kill valve 10 when it is initially placed in the well conduit 20. Therefore, an arming feature may be incorporated as best seen in FIGS. 1D and 1E. The arming feature includes a ball 86 locked in a groove 88 in the flow tube 32 and held therein by a backup shoulder 90 which is secured to the sleeve 22 by a shear pin 92. When the well is completed and before production begins, a wire-line tool is run through the valve 10 to engage a no go 94 on the locking shoulder 90 to shear the pin 92, allow the shoulder 90 to move downwardly and away from the locking ball 86 thereby releasing and arming the valve 10.

The valve is now ready for use, and in operation, as previously described, an increase in the annulus pressure outside of the housing 12 will act on the piston and cylinder assembly 50 and when a predetermined differential of annulus to bore pressure 14 is created, the assembly 50 will move downwardly to release the ball 46, the spring 36 will then move the flow tube 32 upwardly allowing the flapper check valve 26 to close. After the pressure in the tubing 20 above the valve element 26 has been reduced, the formation pressure in the tubing 20 below the check valve 26 will move the sleeve 22 upwardly to bring the opening 60 and 70 into alignment and fluid may thereafter be pumped down the annulus through the communication path through the openings 60 and 70 and downwardly through the check valve 26 to kill production of the well.

Other and further embodiments of the valve 10 may be provided such as shown in FIGS. 3A, 3B, 3C and 4 where like parts are designated with like numerals with the addition of the suffix "a". Therefore, valve **10*a* includes a housing 12*a* having a bore 14*a* for connection in a well tubing 20 by means of an upper thread 16*a* and a lower thread 18*a*. A tubular sleeve 22*a* is telescopically movable in the housing 12*a*, but release means such as a spring collet 24*a* coacts with a recess 25*a* in the housing 12*a* for initially positioning the sleeve in the housing 12*a***.

Figure 3A:
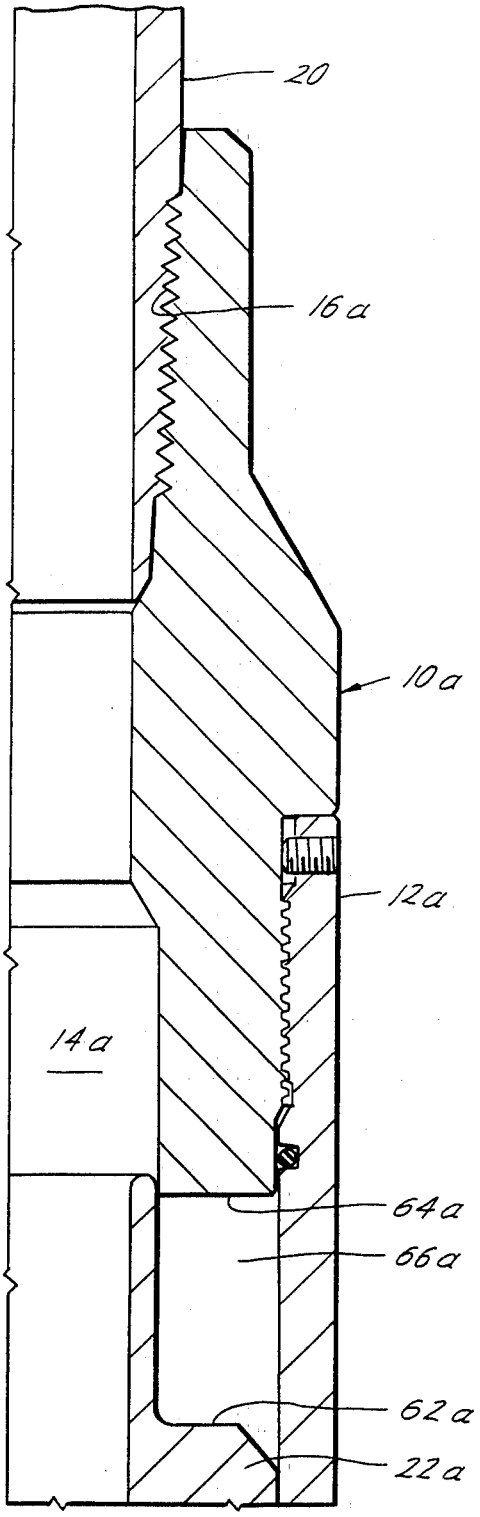
Figure 3B:
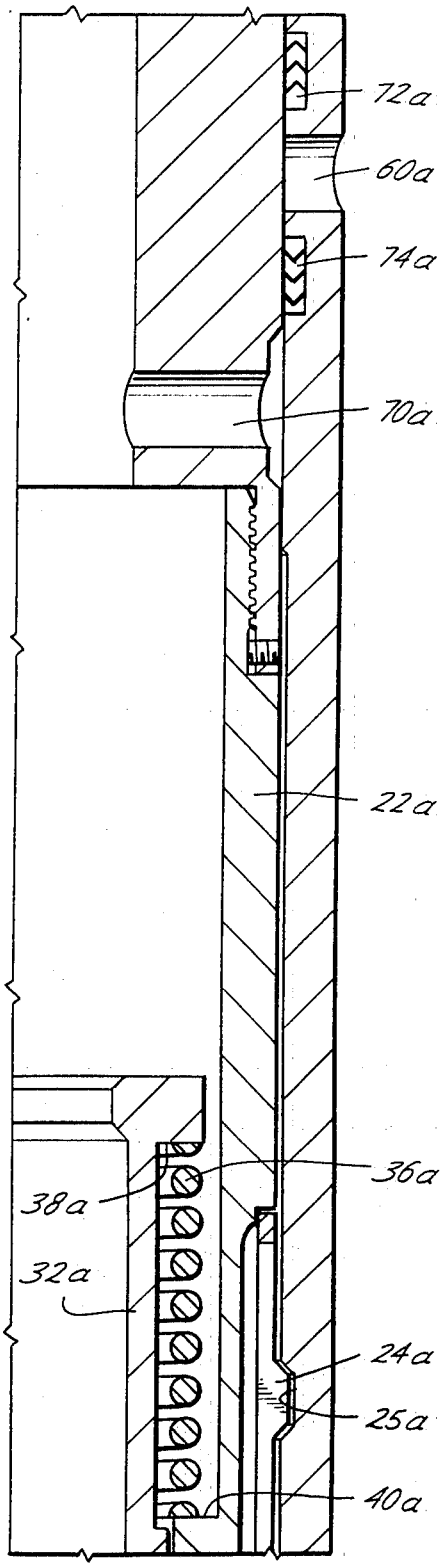
Figure 3C:
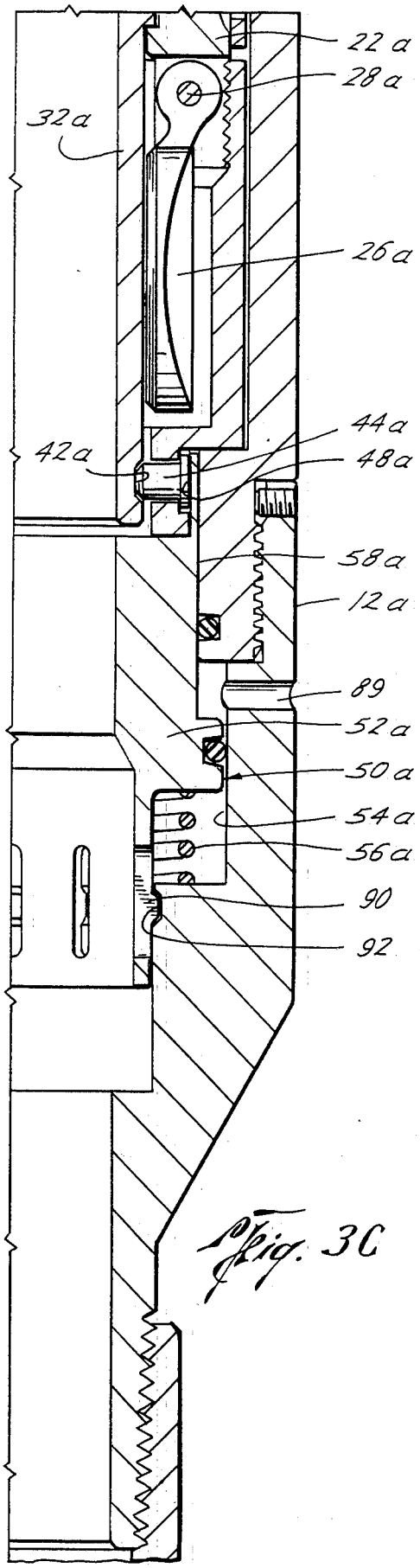
Figure 4:
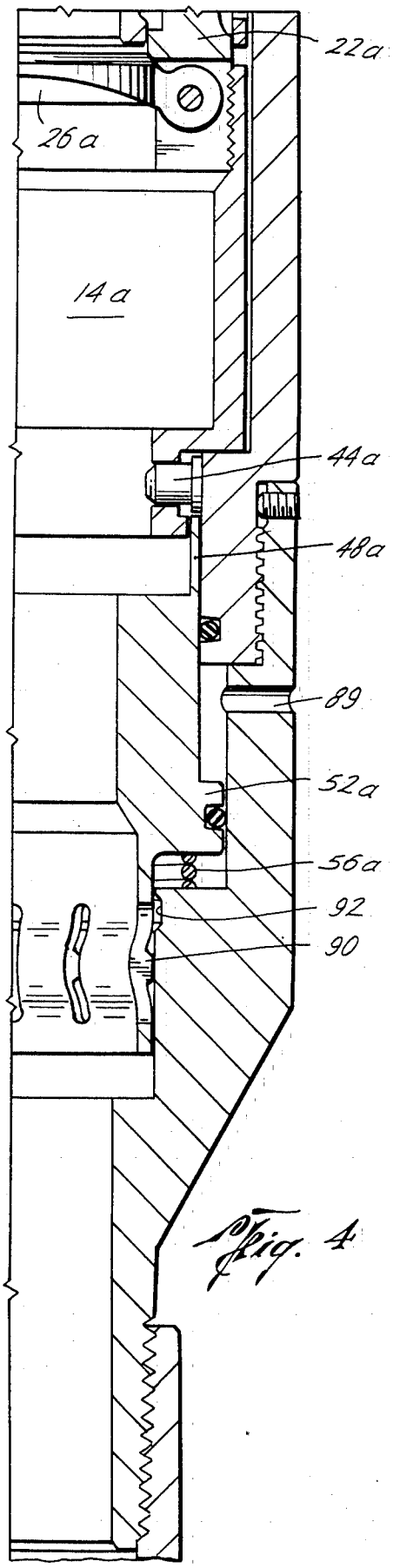
FIG. 4 is a view similar to FIG. 3C showing the valve in the closed position.

A check valve closure member such as a flapper valve **26*a* is connected to the sleeve by a pivot connection 28*a* and is movable from an open position, as best seen in FIG. 3C to a closed position, as best seen in FIG. 4, to shut off upward flow through the bore 14*a* but to allow downward flow through the bore 14*a*. The valve closure member 26*a* is moved to an open position by a flow tube 32*a*, and moves to a closed position by upward flow to the bore 14*a* when the tube 32*a*** is retracted.

Flow tube **32*a* is longitudinally movable in the housing 12*a* for controlling the movement of the check valve member 26*a*. Biasing means such as a spring 36*a* is provided between a shoulder 38*a* on the flow tube 32*a* and a shoulder 40*a* on the sleeve 22*a* for biasing the flow tube 32*a* in a direction for causing the valve member 26*a*** to move to the closed position.

The valve **10*a* is installed in the production tubing 20 in an open position. In order to hold the valve element 26*a* in the open position with the flow tube 32*a* in a downward position, a releasable and engagable latch means is provided initially holding the flow tube 32*a* in a downward position. Thus, referring to FIG. 3C, a groove 42*a* is provided in the outside of the flow tube 32*a* and a locking pin 44*a* is engaged in the groove 42*a*. The pin 44*a* is initially prevented from being displaced from the groove 42*a* by a shoulder 48*a***.

Spring biased piston and cylinder assembly generally indicated by the reference numeral **50*a* includes a piston 52*a* movable in a cylinder 54*a*. The piston 52*a* is biased upwardly by biasing spring 56*a*. A piston rod 58*a* is connected to the shoulder 48*a*. Initially, the spring 56*a* retains the shoulder 48*a* behind the locking pin 44*a*. The assembly 50*a* is exposed on one side to pressure outside of the body 12*a* which would be the annulus between the valve 10 and a well casing (not shown) through an opening 89 and is exposed on the other side to pressure in the bore 14*a*. The piston 52*a* is held in position by a collet 90 fitting in a groove 92 in the housing 12*a*. The pressure in the bore 14*a* flows between the collet 90 and the housing 12*a* and acts on the underside of the piston 52*a* to assist the spring 56*a* to maintain the releasable latch in the latched position. Therefore, the piston 50*a* is exposed on the top to the pressure in the annulus outside of the valve 10*a* and is exposed on the bottom to the pressure inside the bore 14*a***.

Release of the flow tube **32*a* is actuated by an increase in the annular or outside fluid pressure relative to the tubing or bore pressure 14*a* of a predetermined set value. Upon a predetermined increase in the outside pressure relative to the bore pressure, the piston 52*a* moves downwardly moving the shoulder 48*a* out from behind the pin 44*a* at which time the biasing spring 36*a* moves the flow tube 32*a* upwardly allowing the check valve member 26*a* to close the bore 14*a* as best seen in FIG. 4**.

After the check valve **26*a* is closed, the formation pressure in the bore 14*a* below the closure member 26*a* moves the sleeve 22*a* upwardly by overcoming the collet 24*a*. A fluid chamber 66*a* (FIG. 3A) is formed between the sleeve 22***a* and the housing 12*a* having a fluid outlet between the sleeve 22*a* and the housing 12*a* whereby the fluid chamber 66*a* acts as a cushion. A fluid path is then established between the outside of the housing 12*a* and the bore 14*a* which includes one or more fluid openings 60*a* in the housing 12*a* and one or more fluid openings 70*a* in the sleeve 22*a*. The communication path is closed when the sleeve 22*a* is in its initial position by the position of seals 72*a* and 74*a*. However, when the sleeve 22*a* is moved upwardly with the shoulder 62*a* contacting the shoulder 64*a* on the body 12*a*, the openings 60*a* and 70*a* are aligned. Injection fluid may now be pumped down the annulus between the the outside of the body 12*a* and the inside of the casing (not shown), through the communication path consisting of the openings 60*a*, and 70*a* and downwardly through the check valve 26*a*, which will open in response to fluid flow, and the fluid is pumped into the production tubing 20 to kill the production.

The valve 10*a* of the present invention may also be reactivated after the well has been controlled by a suitable shifting tool, such as a wireline tool, engaging the top of the flow tube 32*a* and moving the assembly to its original position.

The method of killing production of an oil and/or gas well is apparent from the foregoing description of the apparatus. The method comprehends inserting a safety valve in the well conduit in the open position, actuating the safety valve to the closed position by an increase of pressure outside of the conduit relative to the pressure on the inside of the conduit. After the valve is closed, the method includes establishing communication of fluid from the outside of the conduit to the inside of the conduit above the safety valve by pressure in the conduit below the closed safety valve, and thereafter injecting fluid from the outside of the conduit through the communication path and into the safety valve to kill production through the conduit. The method further comprehends reactivating the production by closing the communication path and releasably latching the safety valve in the open position.

The method further comprehends inserting a safety valve in the well conduit and initially releasably holding the valve in the open position by a piston and cylinder assembly which is exposed to pressure in the well conduit and to pressure outside of the well conduit, actuating the assembly to move the valve to the closed position by an increase in pressure outside of the conduit relative to the pressure inside of the conduit, opening a communication path from the outside of the conduit to the inside of the conduit above the safety valve by moving the valve upwardly in the conduit by pressure in the conduit below the closed safety valve, and thereafter injecting fluid from the outside of the conduit through the communication path of the safety valve and through the safety valve by opening the valve to kill production through the conduit while maintaining a safety check on the fluid in the well conduit below the safety valve.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. A choke and kill safety valve for use in a well conduit comprising, a housing having a bore therethrough, a sleeve telescopically movable in the housing about the bore, a valve closure member positioned in the housing and connected to the sleeve and movable between open and closed positions in the bore, a flow tube longitudinally movable in the housing for controlling the movement of the valve closure member, means between the sleeve and the flow tube for biasing the flow tube in a direction for causing the valve closure member to move to the closed position, releasable latch means between the sleeve and the flow tube initially holding the flow tube in position holding the valve closure member in the open position, a biased piston and cylinder assembly initially engaging the releasable latch and holding the latch engaged, said assembly being exposed on opposite sides to pressure in the housing and to pressure outside of the housing, and disengaged upon a predetermined increase of ouside pressure relative to bore pressure, and said housing and said sleeve including openings which when aligned by movement of the sleeve by well pressure allows fluid to be inserted into the bore from the outside of the housing.

2. The apparatus of claim 1 including, a fluid chamber between the sleeve and the housing having a small outlet for cushioning the movement of the sleeve relative to the housing.

3. The apparatus of claim 1 wherein the releasable latch means is relatchable.

4. The apparatus of claim 1 including, release means between the sleeve and the housing initially positioning the sleeve relative to the housing.

5. The apparatus of claim 1 including, arming means between the sleeve and the flow tube for initially preventing movement of the flow tube relative to the sleeve.

6. The apparatus of claim 1 wherein the cross-section area of the openings through the housing and sleeve are substantially equal to the cross-sectional area of the bore.

7. The apparatus of claim 1 including, metal seals on the sleeve on each side of the opening in the housing and the opening in the sleeve for preventing fluid bypass around the sleeve regardless of the position of the sleeve relative to the housing.

8. A choke and kill valve for use in a well conduit comprising, a housing and an opening in the housing having a bore therethrough, a sleeve telescopically movable in the housing about the bore, a check valve closure member positioned in the housing and connected to the sleeve and movable between open and closed positions in the bore, a flow tube longitudinally movable in the housing for controlling the movement of the valve closure member, spring biasing means between the sleeve and the flow tube for biasing the tube in a direction for causing the valve member to move to the closed position, releasable and reengagable latch means initially holding the flow tube in position holding the valve closure member in the open position, a spring biased piston and cylinder assembly initially engaging the releasable latch holding the latch engaged, said assembly being exposed on one side through the housing opening to pressure outside of the housing and being exposed on another side to pressure inside the housing bore, said assembly releasing the latch upon a predetermined increase of pressure outside of the housing relative to bore pressure, a communication path extending from outside the housing, through the housing and sleeve into the bore, and release means between the sleeve and the housing initially positioning the sleeve relative to the housing to close the communication path.

9. The apparatus of claim 8 wherein the piston and cylinder assembly is connected to the sleeve and the housing opening forms a part of the communication path.

10. The method of killing production of an oil and/or gas well through a well conduit comprising, inserting a safety valve in the well conduit in the open position, actuating the safety valve to the closed position by an increase of the pressure outside of the conduit relative the pressure on the inside of the conduit, after the valve is closed establishing communication of fluid from the outside of the conduit to the inside of the conduit above the safety valve by pressure in the conduit below the closed safety valve and injecting fluid from the outside of the conduit through the communication path and through the safety valve to kill production through the conduit.

11. The method of claim 10 including reactivating production comprising, closing the communication path, and releasably latching the safety valve in the open position.

12. The method of killing production of an oil and/or gas well through a well conduit comprising, inserting a check safety valve in the well conduit, initially releasably holding the valve in the open position by a piston and cylinder assembly which is exposed to pressure in the well conduit and to pressure outside of the well conduit, actuating the assembly to move the valve to the closed position by an increase in pressure outside of the conduit relative the pressure inside of the conduit, opening a communication path from the outside of the conduit to the inside of the conduit above the valve by moving the valve upwardly in the conduit by pressure in the conduit below the closed safety valve, and injecting fluid from the outside of the conduit through the communication path above the safety valve, and through the safety valve by opening the valve to kill production through the conduit while maintaining a safety check on the fluid in the well conduit below the safety valve.

13. The method of claim 12 including reactivating production through the conduit including, closing the communication path, and releasably latching the safety valve in the open position.

* * * * *